US009849065B1

(12) United States Patent
Kozlevcar

(10) Patent No.: US 9,849,065 B1
(45) Date of Patent: Dec. 26, 2017

(54) TRIGGER POINT MASSAGE APPARATUS

(71) Applicant: Dane Kozlevcar, Union Dale, PA (US)

(72) Inventor: Dane Kozlevcar, Union Dale, PA (US)

( * ) Notice: Subject to any disclaimer, the term of this patent is extended or adjusted under 35 U.S.C. 154(b) by 398 days.

(21) Appl. No.: 14/721,406

(22) Filed: May 26, 2015

(51) Int. Cl.

| | |
|---|---|
| ***A61H 7/00*** | (2006.01) |
| ***A61H 19/00*** | (2006.01) |
| ***A61H 39/04*** | (2006.01) |
| *A61H 15/00* | (2006.01) |

(52) U.S. Cl.
CPC ..... *A61H 39/04* (2013.01); *A61H 15/00* (2013.01); *A61H 2201/0119* (2013.01); *A61H 2201/0123* (2013.01)

(58) Field of Classification Search
CPC ..... A61H 15/00; A61H 15/0078; A61H 15/0085; A61H 15/0092; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 2201/0123; A61H 2201/0126
See application file for complete search history.

(56) References Cited

U.S. PATENT DOCUMENTS

| | | | | |
|---|---|---|---|---|
| 2,328,156 | A * | 8/1943 | London | A61H 15/00 482/132 |
| 2,347,327 | A * | 4/1944 | London | A61H 15/00 482/132 |
| 4,374,519 | A | 2/1983 | Stauft | |
| 4,416,271 | A * | 11/1983 | Chester | A61H 15/00 482/904 |
| 5,690,604 | A * | 11/1997 | Barnett | A61H 19/44 248/229.15 |
| 7,087,004 | B1 * | 8/2006 | Berke | A61H 7/002 482/132 |
| D535,752 | S | 1/2007 | Smith | |
| 7,645,248 | B2 * | 1/2010 | Brown | A61H 15/00 601/122 |
| 2002/0193715 | A1 | 12/2002 | Slack | |
| 2004/0243035 | A1 | 12/2004 | Devlin | |
| 2007/0276438 | A1 * | 11/2007 | Meglin | A61H 1/0292 606/237 |

(Continued)

FOREIGN PATENT DOCUMENTS

CA 2323322 A1 4/2002

*Primary Examiner* — Joshua Lee
(74) *Attorney, Agent, or Firm* — Kyle A. Fletcher, Esq.

(57) ABSTRACT

The trigger point massage apparatus includes a primary pegboard from which a trigger point massage member is selectively affixed. A pair of side members attach to opposing sides of the primary pegboard in order to form a device that is adapted to secure against a doorframe. The pair of side members optionally includes at least one locking screw that is used to tighten a pad member in order to secure the device against the doorframe. The trigger point massage member includes a plurality of pins that are selectively engaged into one of a plurality of pinholes provided on an outer surface of the primary pegboard. The trigger point massage member includes a rotatable sphere that is extended from armatures of the trigger point massage member. The rotatable sphere is adapted to be engaged against a body part in order to provide a massage thereto.

13 Claims, 4 Drawing Sheets

(56) References Cited

U.S. PATENT DOCUMENTS

| | | | | |
|---|---|---|---|---|
| 2008/0077062 | A1* | 3/2008 | Leiter | A61H 7/00 601/134 |
| 2011/0166481 | A1* | 7/2011 | Rhoad | A61H 7/002 601/1 |
| 2011/0237990 | A1* | 9/2011 | Marsten | A61H 15/00 601/119 |
| 2012/0028765 | A1* | 2/2012 | Morin | A61H 15/00 482/91 |
| 2015/0157414 | A1* | 6/2015 | Van Curen | A61H 7/001 606/131 |
| 2015/0231016 | A1* | 8/2015 | Stearns | A61H 7/001 601/136 |

* cited by examiner

TRIGGER POINT MASSAGE APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to massage devices, and more specifically, a massage apparatus that is secured to a stationary object and against which a person rests against in order to massage.

SUMMARY OF INVENTION

The present invention involves a primary pegboard from which a trigger point massage member is selectively affixed. A pair of side members attach to opposing sides of the primary pegboard in order to form a device that is adapted to secure against a doorframe. The pair of side members optionally includes at least one locking screw that is used to tighten a pad member in order to secure the device against the doorframe. The primary pegboard includes channel members on opposing ends of an inner surface. The channel members enable notched surfaces of the side members to slide thereon so as to secure the side members to the primary pegboard. The trigger point massage member includes a plurality of pins that are selectively engaged into one of a plurality of pinholes provided on an outer surface of the primary pegboard. The trigger point massage member includes a rotatable sphere that is extended from armatures of the trigger point massage member. The rotatable sphere is adapted to be engaged against a body part in order to provide a massage thereto.

These together with additional objects, features and advantages of the trigger point massage apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the trigger point massage apparatus in detail, it is to be understood that the trigger point massage apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the trigger point massage apparatus.

It is therefore important that the claims be regarded as including such equivalent construction insofar as they do not depart from the spirit and scope of the trigger point massage apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
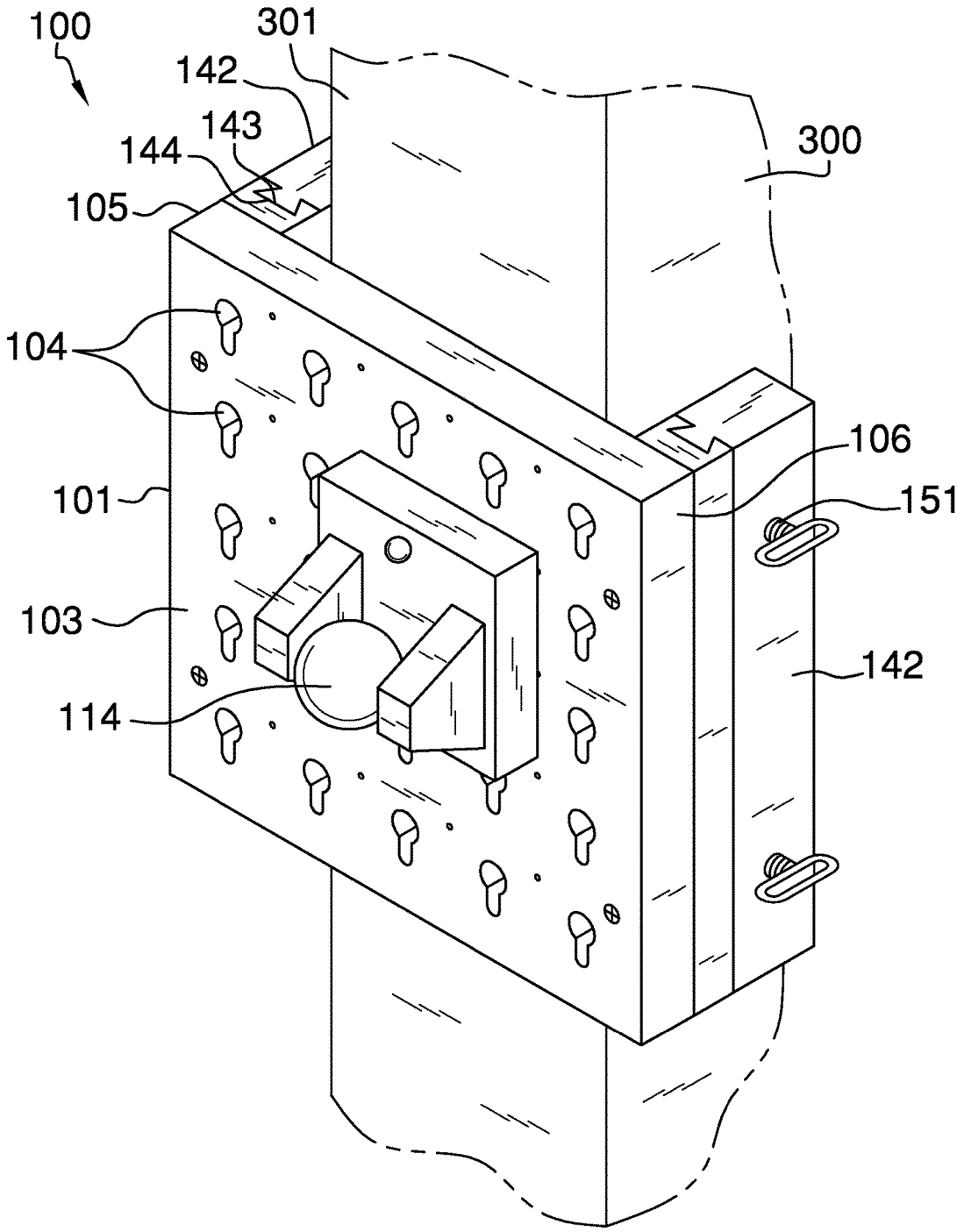
FIG. 1 is a perspective view of an embodiment of the disclosure installed.
Figure 2:
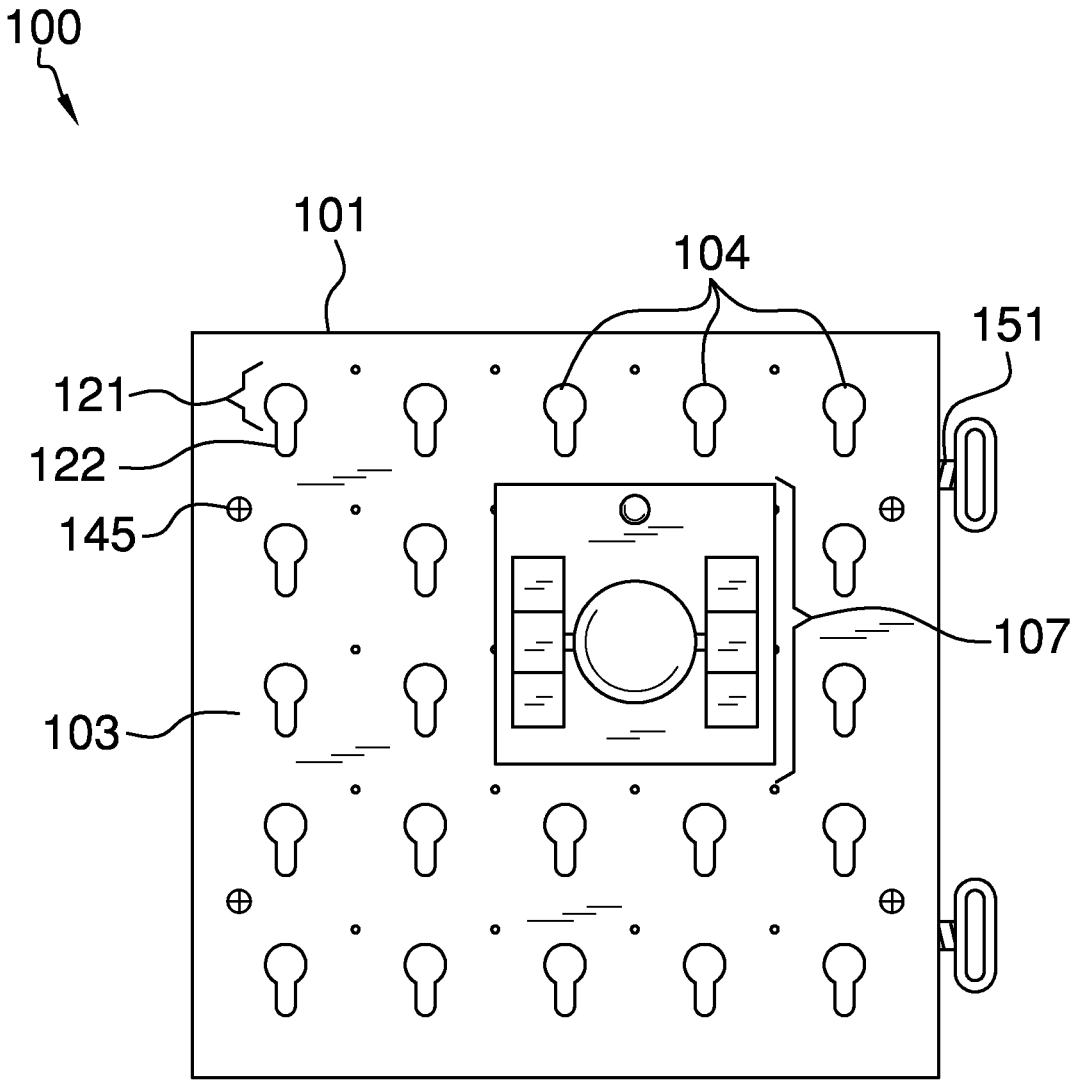
FIG. 2 is a front view of an embodiment of the disclosure.
Figure 3:
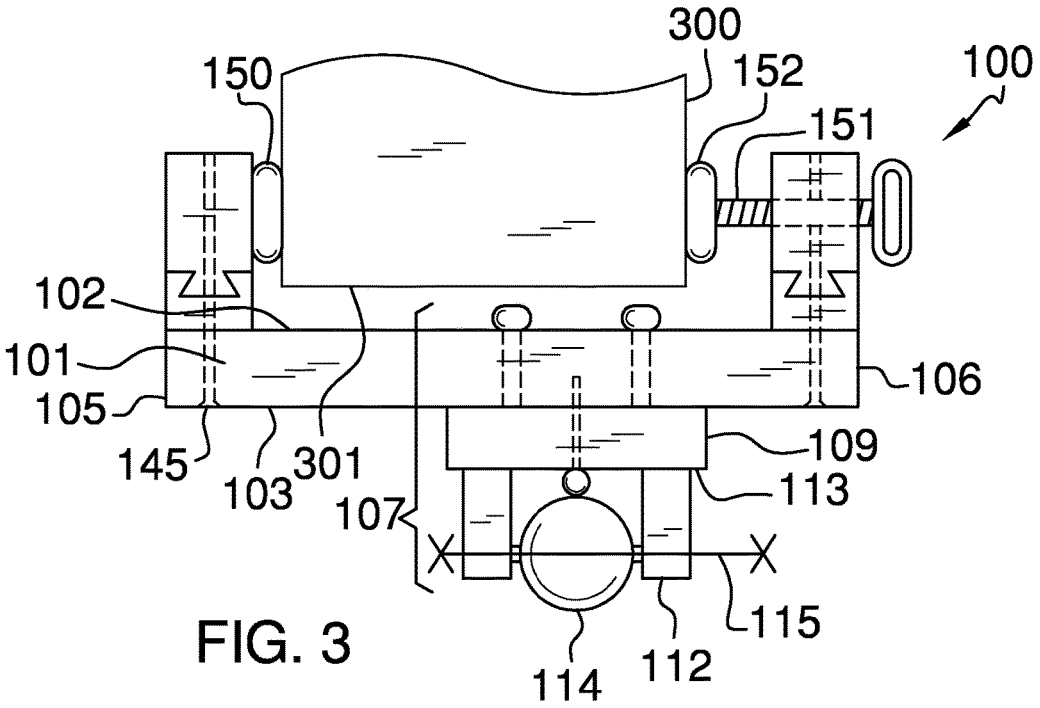
FIG. 3 is a top view of an embodiment of the disclosure installed.
Figure 4:
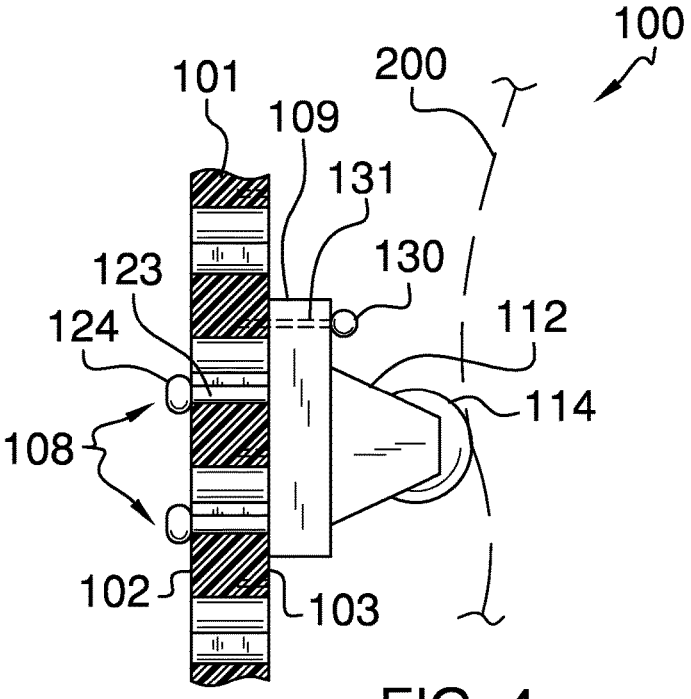
FIG. 4 is a sectional view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The trigger point massage apparatus 100 (hereinafter invention) includes a primary pegboard 101 that is further defined with an inner surface 102, and an outer surface 103. The primary pegboard 101 is generally planar, and includes an array of a plurality of pinholes 104 across the outer surface 103. Furthermore, the primary pegboard 101 is further defined with a first distal end 105, and a second distal end 106. The first distal end 105 is opposite of the second distal end 106. The first distal end 105 is also parallel with the second distal end 106.

The invention 100 includes a trigger point massage member 107 that is selectively affixed to the primary pegboard 101. Moreover, the trigger point massage member 107 includes a plurality of pins 108 that extend rearwardly from a massage base 109. The plurality of pins 108 are in an array that mimics the array of the plurality of pinholes 104 of the primary pegboard 101 such that the trigger point massage member 107 is able to be affixed at various locales across the outer surface 103 of the primary pegboard 101. It shall be further noted that the massage base 109 is generally planar, and much smaller in size with the primary pegboard 101.

The array of the plurality of pinholes 104 of the primary pegboard 101 is well known in the art. Moreover, the plurality of pinholes 104 are each further defined as a first circle 121 with an elongated circle 122 extending downwardly. The plurality of pins 108 of the massage base 109 is each further defined as a first rod member 123 and a bulbous end 124. The plurality of pins 108 extend across the plurality of pinholes 104 of the primary pegboard 101 before sliding down into a locked position such that the massage base 109 is rigidly affixed against the outer surface 103 of the primary pegboard 101.

The massage base 109 of the trigger point massage member 107 includes a pair of armatures 112 that extend outwardly from a second outer surface 113 of the massage base 109. The pair of armatures 112 support a rotatable sphere 114 along a horizontal axis 115. The rotatable sphere 114 is adapted to rubbed against via a body part 200 in order to provide a massage thereto, and which is the primary function of the invention 100.

It shall be noted that the trigger point massage member 107 may require a locking pin 130 to be included, and used to secure the massage base 109 against the outer surface 103 of the primary pegboard 101. Moreover, the locking pin 130 extends through a massage pinhole 131 of the massage base 109, and into one of plurality of pegboard lock holes 132 provided on the outer surface 103 of the primary pegboard 101. The locking pin 130 is used once the plurality of pins 108 are secured to the selected array of the plurality of pinholes 104 of the primary pegboard 101.

Figure 5:
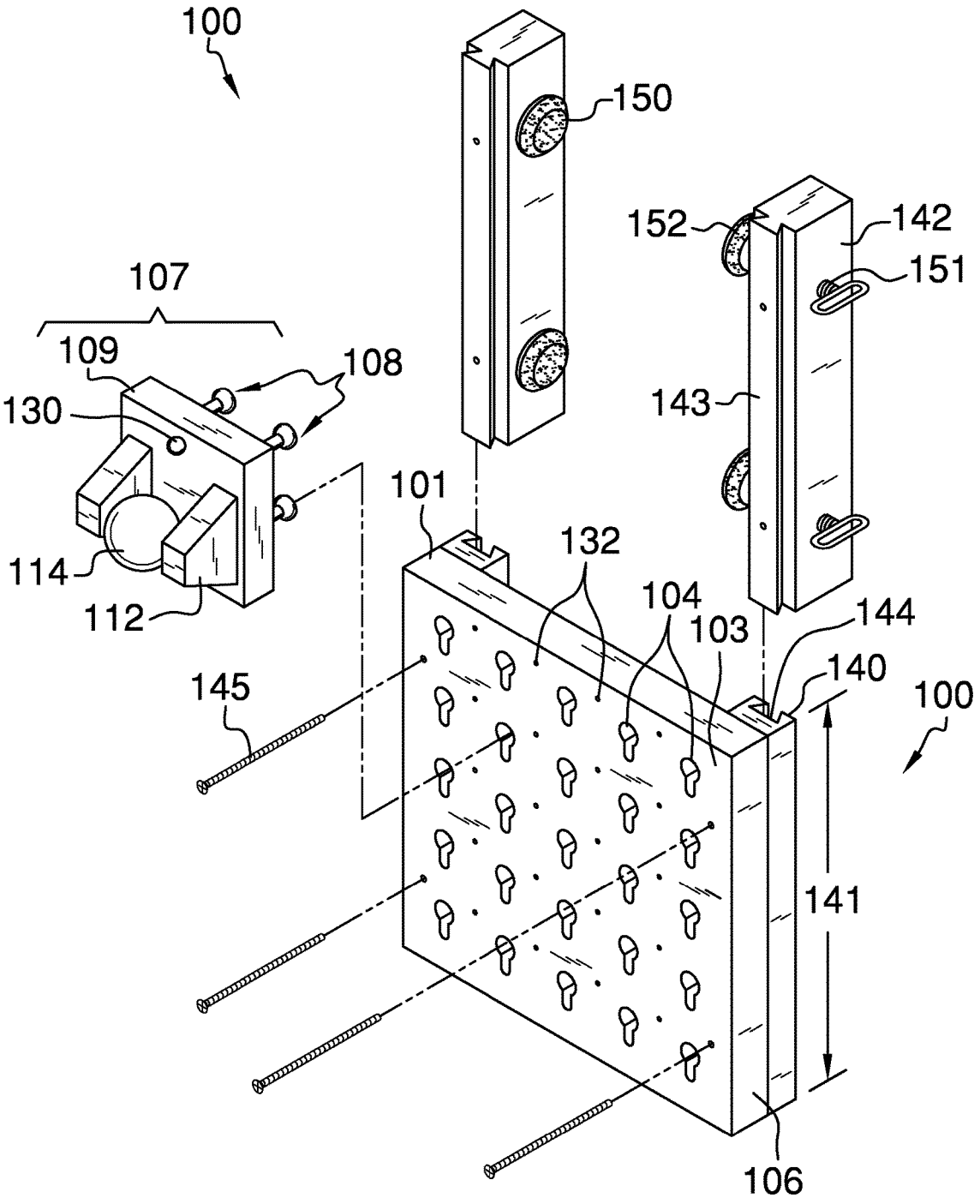
FIG. 5 is an exploded view of an embodiment of the disclosure.

The first distal end 105 and the second distal end 106 of the primary pegboard 101 each include a channel member 140 affixed thereon. Moreover, the channel member 140 is located on the inner surface 103 of the primary pegboard 101. The channel member 140 extends along a height 141 of the primary pegboard 101. The channel members 140 of the primary pegboard 101 enable a one of a pair of side members 142 to be affixed onto the first distal end and the second distal end 106 of the primary pegboard 101. Referring to FIG. 5, the pair of side members 142 each include a notched surface 143 that slides into a channel 144 provided on the channel members 140. Screws 145 may be used thereafter to secure the pair of side members 142 to the rear surface 102 of the primary pegboard 101.

The pair of side members 142 and the primary pegboard 101 form a "U"-shaped assembly that is adapted to be affixed onto a distal end 301 of a doorframe 300. Therefore, the invention 100 is adapted to be secured to the doorframe 300 whilst the trigger point massage member 107 is used to adaptively massage said body part 200.

The pair of side members 142 each include at least one pad member 150 and/or at least one locking screw 151. The at least one locking screw 151 includes a second pad member 152. The pad member 150 and the second pad member 152 are provided on opposing sides of the invention 100, and work in concert to provide clamping force that secures the invention 100 onto the doorframe 300.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A trigger point massage apparatus comprising:

a trigger point massage member that is selectively secured against a primary pegboard;

wherein the trigger point massage member is adapted to massage a body part;

wherein the primary pegboard is adapted to be secured against a distal end of a doorframe;

wherein the primary pegboard is further defined with an inner surface, and an outer surface; wherein the primary pegboard is generally planar, and includes an array of a plurality of pinholes across the outer surface;

wherein the primary pegboard is further defined with a first distal end, and a second distal end; wherein the first distal end is opposite of the second distal end; wherein the first distal end is also parallel with the second distal end;

wherein the trigger point massage member is selectively affixed to the primary pegboard; wherein the trigger point massage member includes a plurality of pins that extend rearwardly from a massage base;

wherein the plurality of pins are arranged in an array that selectively engage with a selected array of the plurality of pinholes of the primary pegboard such that the trigger point massage member is able to be affixed at various locales across the outer surface of the primary pegboard; wherein the massage base is generally planar, and smaller in size than the primary pegboard.

2. The trigger point massage apparatus according to claim 1 wherein the plurality of pinholes of the primary pegboard are each further defined as a first circle with an elongated circle extending downwardly; wherein the plurality of pins of the massage base are each further defined as a first rod member and a bulbous end; wherein the plurality of pins extend across the plurality of pinholes of the primary pegboard before sliding down into a locked position such that the massage base is rigidly affixed against the outer surface of the primary pegboard.

3. The trigger point massage apparatus according to claim 2 wherein the massage base of the trigger point massage member includes a pair of armatures that extend outwardly from a second outer surface of the massage base.

4. The trigger point massage apparatus according to claim 3 wherein the pair of armatures support a rotatable sphere along a horizontal axis; wherein the rotatable sphere is adapted to rub again the body part in order to provide a massage thereto.

5. The trigger point massage apparatus according to claim 4 wherein the trigger point massage member includes a locking pin that is used to secure the massage base against the outer surface of the primary pegboard; wherein the locking pin extends through a massage pinhole of the massage base, and into one of a plurality of pegboard lock holes provided on the outer surface of the primary pegboard.

6. The trigger point massage apparatus according to claim 5 wherein the locking pin is used once the plurality of pins are secured to the selected array of the plurality of pinholes of the primary pegboard.

7. The trigger point massage apparatus according to claim 6 wherein the first distal end and the second distal end of the primary pegboard each includes a channel member affixed thereon; wherein the channel member is located on the inner surface of the primary pegboard; wherein the channel member extends along a height of the primary pegboard.

8. The trigger point massage apparatus according to claim 7 wherein the channel members of the primary pegboard enable a pair of side members to be affixed onto the first distal end and the second distal end of the primary pegboard, respectively; wherein the pair of side members each includes a notched surface that slides into a channel provided on each of the channel members.

9. The trigger point massage apparatus according to claim 8 wherein screws are used to secure the pair of side members to the inner surface of the primary pegboard.

10. The trigger point massage apparatus according to claim 9 wherein the pair of side members and the primary pegboard form a "U"-shaped assembly that is adapted to be affixed onto the distal end of the doorframe.

11. The trigger point massage apparatus according to claim 10 wherein the pair of side members each includes at least one pad member and/or at least one locking screw.

12. The trigger point massage apparatus according to claim 11 wherein the at least one locking screw includes a second pad member.

13. The trigger point massage apparatus according to claim 12 wherein the pad member and the second pad member are provided on opposing sides, and work in concert to provide a clamping force that is adapted to secure the trigger point massage apparatus onto the doorframe.

* * * * *